US010070762B2

(12) United States Patent
Burnham et al.

(10) Patent No.: US 10,070,762 B2
(45) Date of Patent: Sep. 11, 2018

(54) HEAD FOR A SURFACE CLEANING DEVICE

(71) Applicant: TECHTRONIC FLOOR CARE TECHNOLOGY LIMITED, Tortola (VG)

(72) Inventors: Gavin Burnham, West Midlands (GB); Jake Tyler, West Midlands (GB); Matt Ward, West Midlands (GB)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 15/112,754

(22) PCT Filed: Feb. 7, 2014

(86) PCT No.: PCT/GB2014/050358
§ 371 (c)(1),
(2) Date: Jul. 20, 2016

(87) PCT Pub. No.: WO2015/110776
PCT Pub. Date: Jul. 30, 2015

(65) Prior Publication Data

US 2016/0331197 A1 Nov. 17, 2016

(30) Foreign Application Priority Data

Jan. 23, 2014 (GB) ..... 1401131.6

(51) Int. Cl.
*A47L 7/00* (2006.01)
*A47L 9/24* (2006.01)
(Continued)

(52) U.S. Cl.
CPC ..... *A47L 7/0009* (2013.01); *A47L 5/30* (2013.01); *A47L 7/0023* (2013.01);
(Continued)

(58) Field of Classification Search
CPC ..... A47L 7/0009; A47L 7/0023; A47L 5/30; A47L 9/0477; A47L 9/0494; A47L 9/24; A47L 11/4041
See application file for complete search history.

(56) References Cited

U.S. PATENT DOCUMENTS 3,894,308 A 7/1975 Carr
4,151,628 A * 5/1979 Maurer ..... A47L 5/30 15/415.1
(Continued)

FOREIGN PATENT DOCUMENTS

EP 0382598 8/1990
EP 2327348 A1 6/2011
(Continued)

OTHER PUBLICATIONS

United Kingdom Search Report for Application No. 1401131.6 dated May 13, 2014 (2 pages).
(Continued)

*Primary Examiner* — Dung Van Nguyen
(74) *Attorney, Agent, or Firm* — Michael Best & Friedrich LLP

(57) ABSTRACT

A head for a surface cleaning device, the head includes an inlet for receiving dirt-laden fluid from a surface and an inlet extension member. The inlet extension member is movable with respect to the inlet between first and second positions.

24 Claims, 7 Drawing Sheets

(51) Int. Cl.
*A47L 9/04* (2006.01)
*A47L 5/30* (2006.01)
*A47L 11/40* (2006.01)

(52) U.S. Cl.
CPC ..... *A47L 9/0477* (2013.01); *A47L 9/0494* (2013.01); *A47L 9/24* (2013.01); *A47L 11/4041* (2013.01)

(56) References Cited

U.S. PATENT DOCUMENTS 4,638,526 A 1/1987 Murata et al.
7,171,723 B2 * 2/2007 Kobayashi ..... A47L 9/04 15/325
8,555,462 B2 * 10/2013 Maguire ..... A47L 9/0666 15/358
2004/0083574 A1 * 5/2004 Kobayashi ..... A47L 9/04 15/354
2005/0050680 A1 3/2005 Anderson et al.
2005/0091782 A1 5/2005 Gordon
2006/0101604 A1 * 5/2006 Frederick ..... A47L 5/30 15/319
2009/0064446 A1 3/2009 Oh et al.

FOREIGN PATENT DOCUMENTS

GB 2405786 3/2005
GB 2415890 1/2006
WO 2013027164 A1 2/2013

OTHER PUBLICATIONS

International Search Report, PCT/GB2014/050358, dated Sep. 19, 2014.

* cited by examiner

HEAD FOR A SURFACE CLEANING DEVICE

CROSS-REFERENCE TO RELATED APPLICATIONS

This application is a U.S. national phase of International Patent Application No. PCT/GB2014/050358, filed Feb. 7, 2014, which claims priority to UK Patent Application No. 1401131.6, filed Jan. 23, 2014, the entire contents all of which are hereby incorporated by referenced herein.

BACKGROUND

The present invention relates to a head for a surface cleaning device. In some embodiments the invention may relate to a head for an upright surface cleaning device. In other embodiments the invention may relate to a head for a hand-held surface cleaning device or the like. Such surface cleaning devices are often referred to as "wet vacuum cleaners".

It is known to provide surface cleaning devices that operate both on hard (e.g. wooden or vinyl) and on soft (e.g. carpet) floor surfaces. However, a problem with such devices is that they are not configured to readily interchange between a hard floor cleaning mode and a soft floor cleaning mode.

SUMMARY

Embodiments of the present invention seek to provide a head for a surface cleaning device that seeks to overcome, or at least substantially reduce, the disadvantages associated with known surface cleaning heads.

In one aspect of the invention, we provide a head for a surface cleaning device, the head including:

an inlet for receiving dirt-laden fluid from a surface; and an inlet extension member, wherein the inlet extension member is movable with respect to the inlet between first and second positions.

In a second aspect of the invention, we provide a head for a surface cleaning device, the head including:

an inlet for receiving dirt-laden fluid from a surface;

an inlet extension member;

at least one agitator; and at least one wheel for supporting the inlet extension member on the surface, wherein the or each wheel is located between the inlet extension member and the at least one agitator.

DETAILED DESCRIPTION

Figure 1:
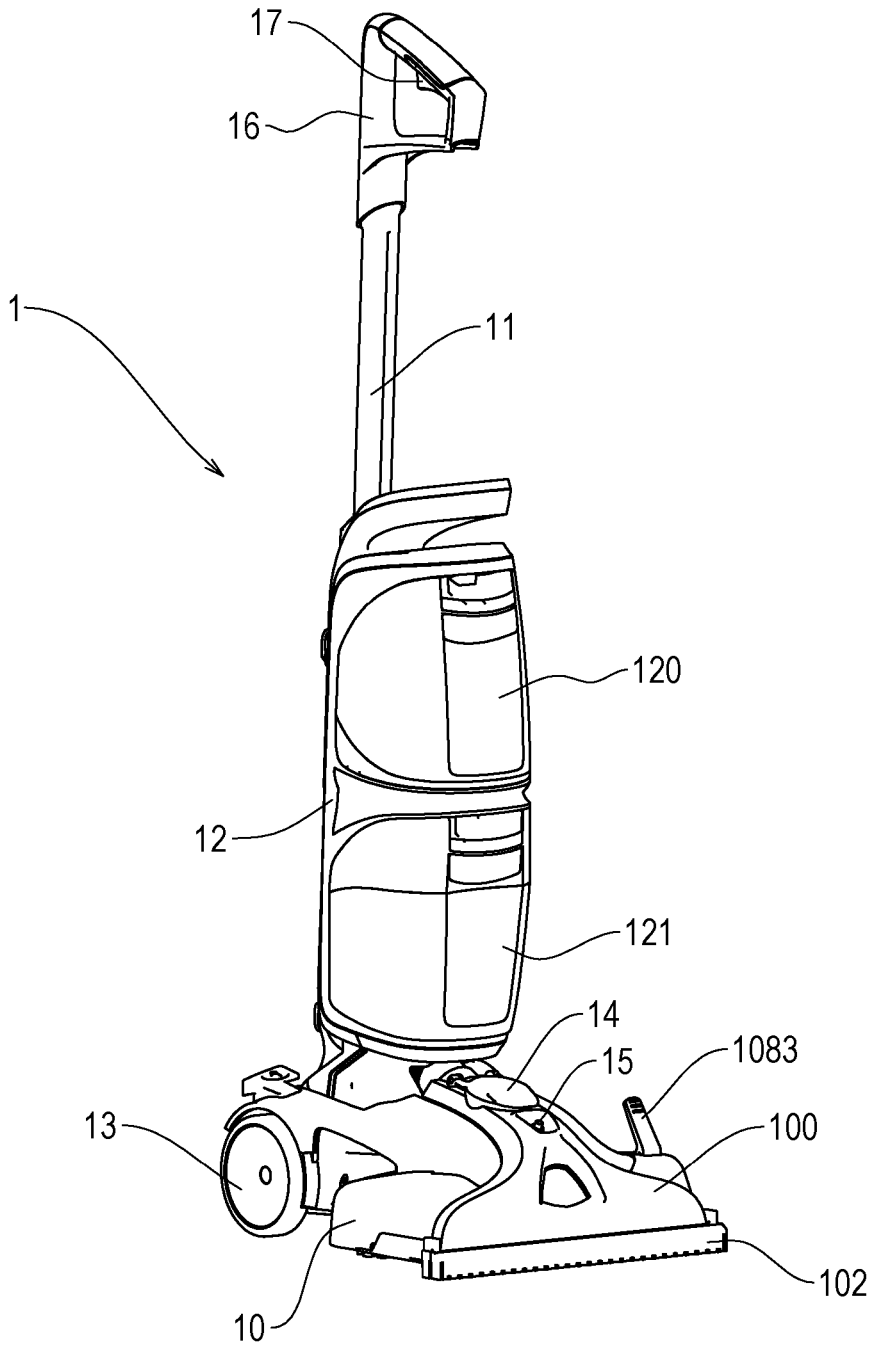
FIG. 1 shows a perspective view of a surface cleaning device including a head according to an embodiment of the present invention.

With reference to FIG. 1 there is shown an embodiment of a surface cleaning device, indicated generally at 1, including a head 10 and an upright support 11. The upright support 11 may be pivotable with respect to the head 10 about an axis extending between a pair of wheels 13 located rearwardly of the head 10.

The device 1 may include a handle 16 and a trigger 17. The device 1 may also include a housing 12 including first 120 and second 121 fluid tanks. Typically, the first fluid tank 120 is for receiving a cleaning solution and the second fluid tank 121 is for recovering dirty fluid. The first 120 and second 121 fluid tanks may be removably mounted to the housing 12.

The device 1 may be operated in various modes. For instance, the device 1 may be used as an upright cleaner to clean hard or soft floor surfaces. Additionally, the device 1 may be used to clean above floor surfaces—for example, by connecting the hose of a wand (not shown) to a port (shown closed in the figures by a cap 14) and by connecting a fluid delivery hose of a wand (not shown) to port 15. In such above floor cleaning modes, suction is redirected from the head 10 to the hose in a manner known in the art, to permit a user to clean above floor surfaces using the wand.

FIGS. 2 to 7 show views of the head 10 in more detail. The head 10 includes a body 100. The head 10 also includes an inlet 101 for receiving dirt-laden fluid from a surface. The inlet 101 is fixed with respect to the body 100. The head 10 may include a rotatably driven brush bar 103 extending from one side of the body 100 to the other. The rotatably driven brush bar 103 preferably includes hard bristles and may include a combination of hard and soft bristles. In the illustrated embodiment a single rotatably driven brush bar 103 is shown. However, it is to be appreciated that in other embodiments the head 10 may include more than one rotatably driven brush bar 103. Indeed, some embodiments may not include any rotatably driven brush bars 103. The head 10 may also include one or more trailing brushes 104 located rearwardly of the rotatably driven brush bar 103. The trailing brushes 104 are configured to rotate about a vertical axis with respect to the surface. The trailing brushes 104 preferably include soft bristles. In the illustrated embodiment there are shown five trailing brushes 104. However, it is to be appreciated that in other embodiments the head 10 may include fewer or greater than five trailing brushes 104. Indeed, some embodiments may not include any trailing brushes 104.

The head 10 includes an inlet extension member 102 which preferably surrounds the inlet 101. In some embodiments the inlet extension member 102 may only partially surround the inlet 101. Indeed, in some embodiments (not shown) the inlet extension member 102 may not surround the inlet 101, but instead the inlet extension member 102 may be located around at least a part of the inside of the inlet 101.

Figure 8:
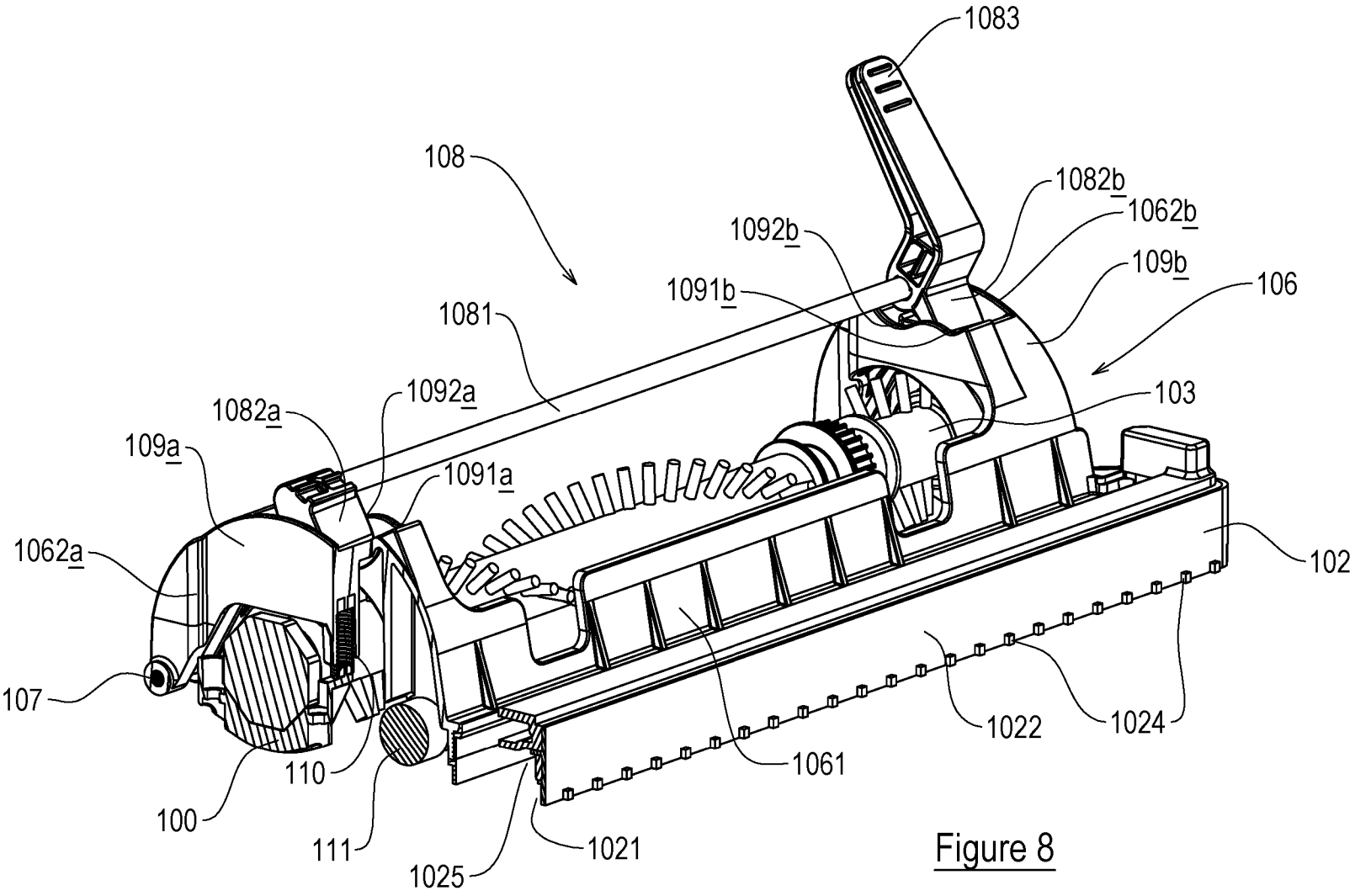
FIG. 8 shows a cutaway view of a head according to an embodiment of the present invention.

Referring now to FIG. 8 the head 10 includes a frame, indicated generally at 106. The frame 106 includes a part 1061 which connects a pair of spaced apart ends 1062*a*, 1062*b*. The ends 1062*a*, 1062*b* are curved to accommodate respective ends of the rotatably driven brush bar 103. The inlet extension member 102 is supported by the frame 106 along the length of the part 1061. The frame 106 may be pivotably mounted to the body 100 about a pivot axis 107. It is to be understood that since the inlet 101 is fixed with respect to the body 100 and the inlet extension member 102 is supported by the frame 106, it will follow that the inlet extension member 102 is movable with respect to the inlet 101 about the pivot axis 107 between first and second positions.

Figure 7:
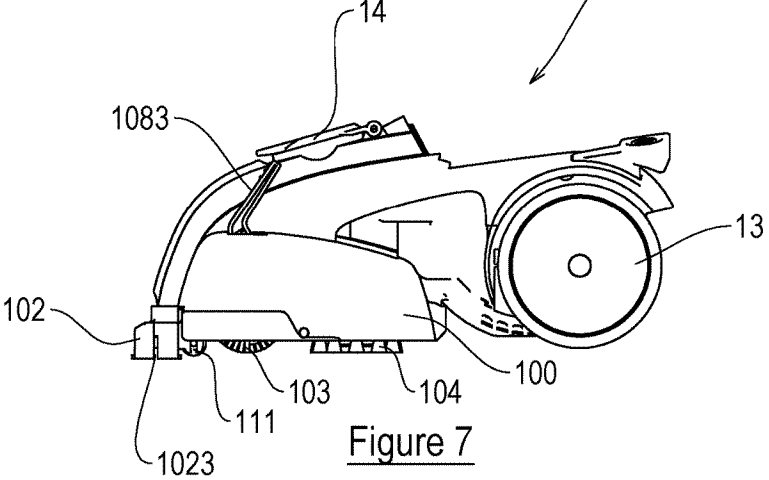
FIG. 7 shows a side view of a head according to an embodiment of the present invention in a second configuration.
Figure 5:
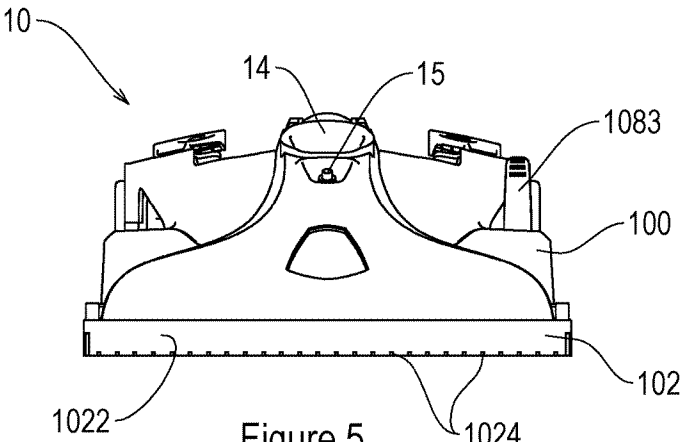
FIG. 5 shows a front view of a head according to an embodiment of the present invention in a second configuration.
Figure 3:
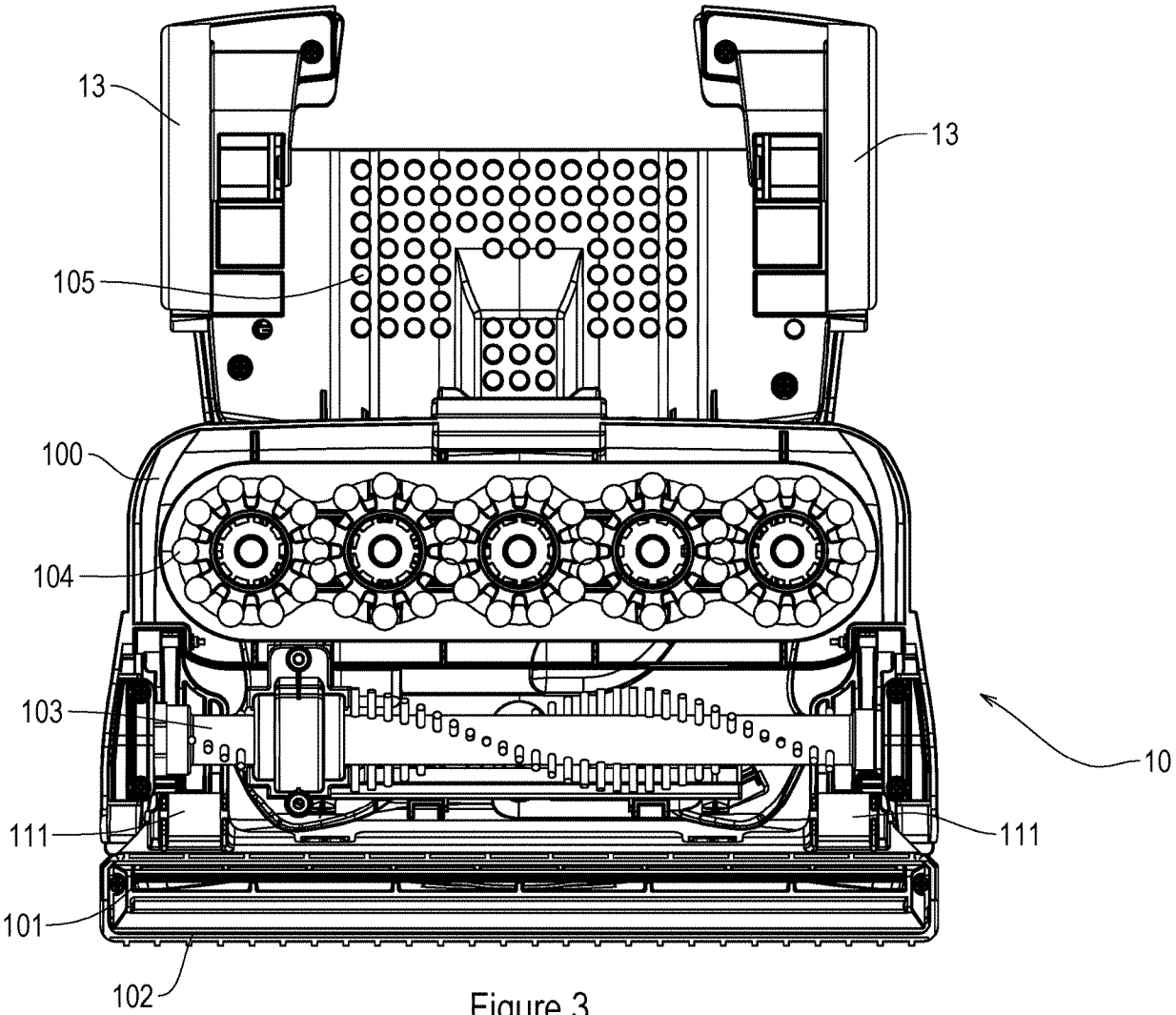
FIG. 3 shows a bottom view of a head according to an embodiment of the present invention.
Figure 6:
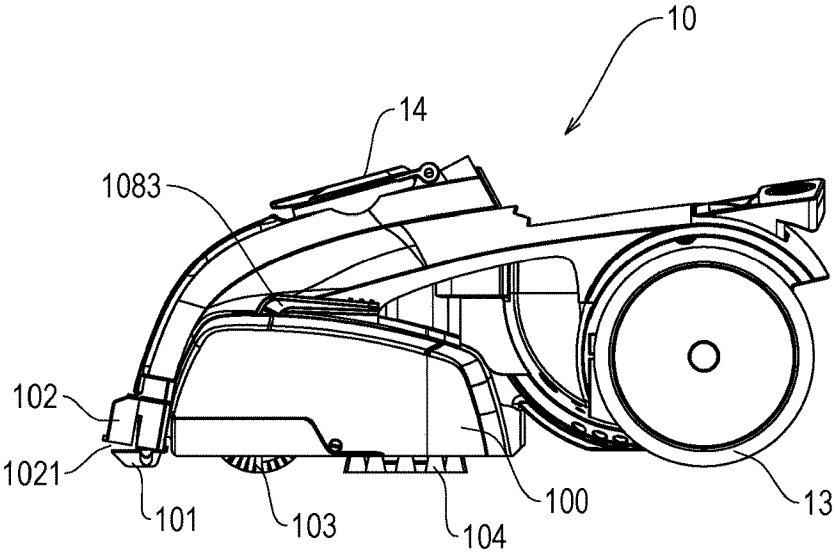
FIG. 6 shows a side view of a head according to an embodiment of the present invention in a first configuration.
Figure 4:
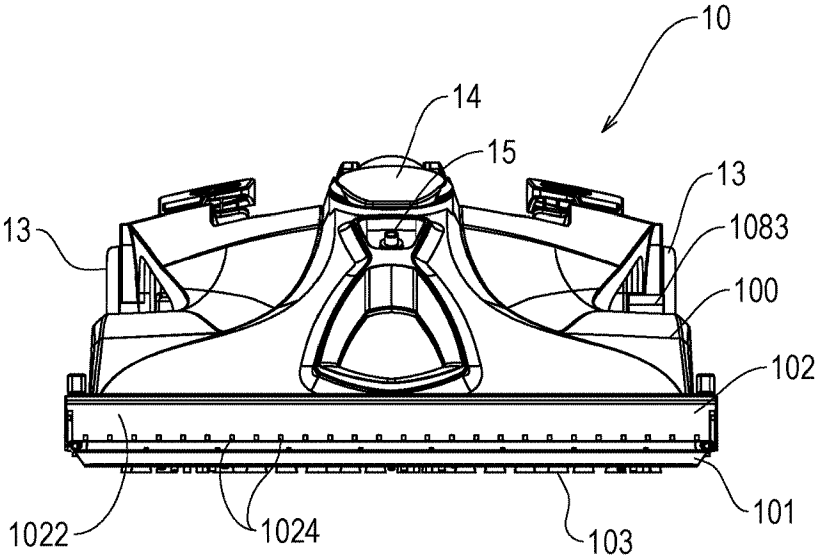
FIG. 4 shows a front view of a head according to an embodiment of the present invention in a first configuration.
Figure 9:
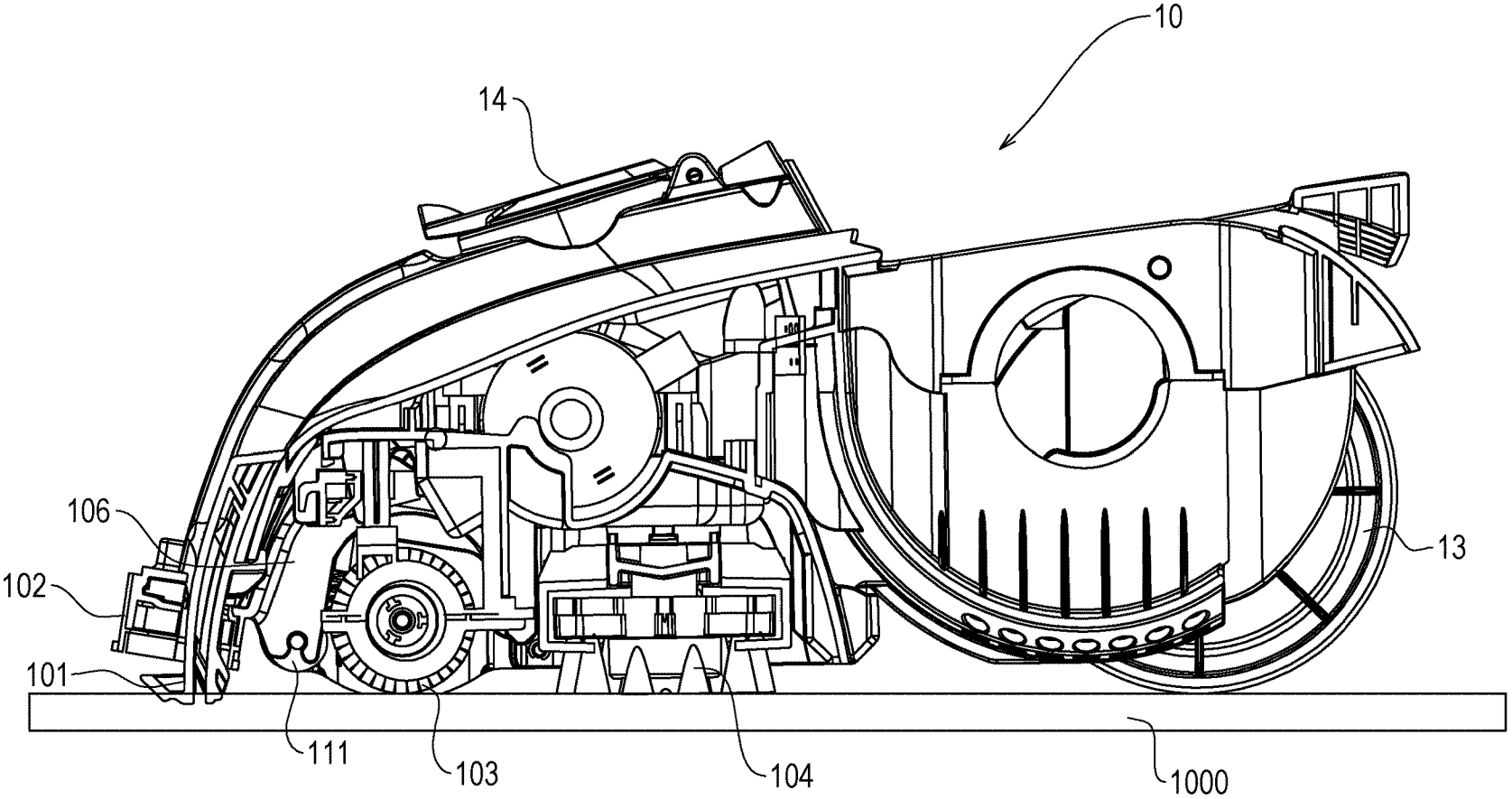
FIG. 9 shows a cross sectional view of a head according to an embodiment of the present invention in a first configuration.
Figure 10:
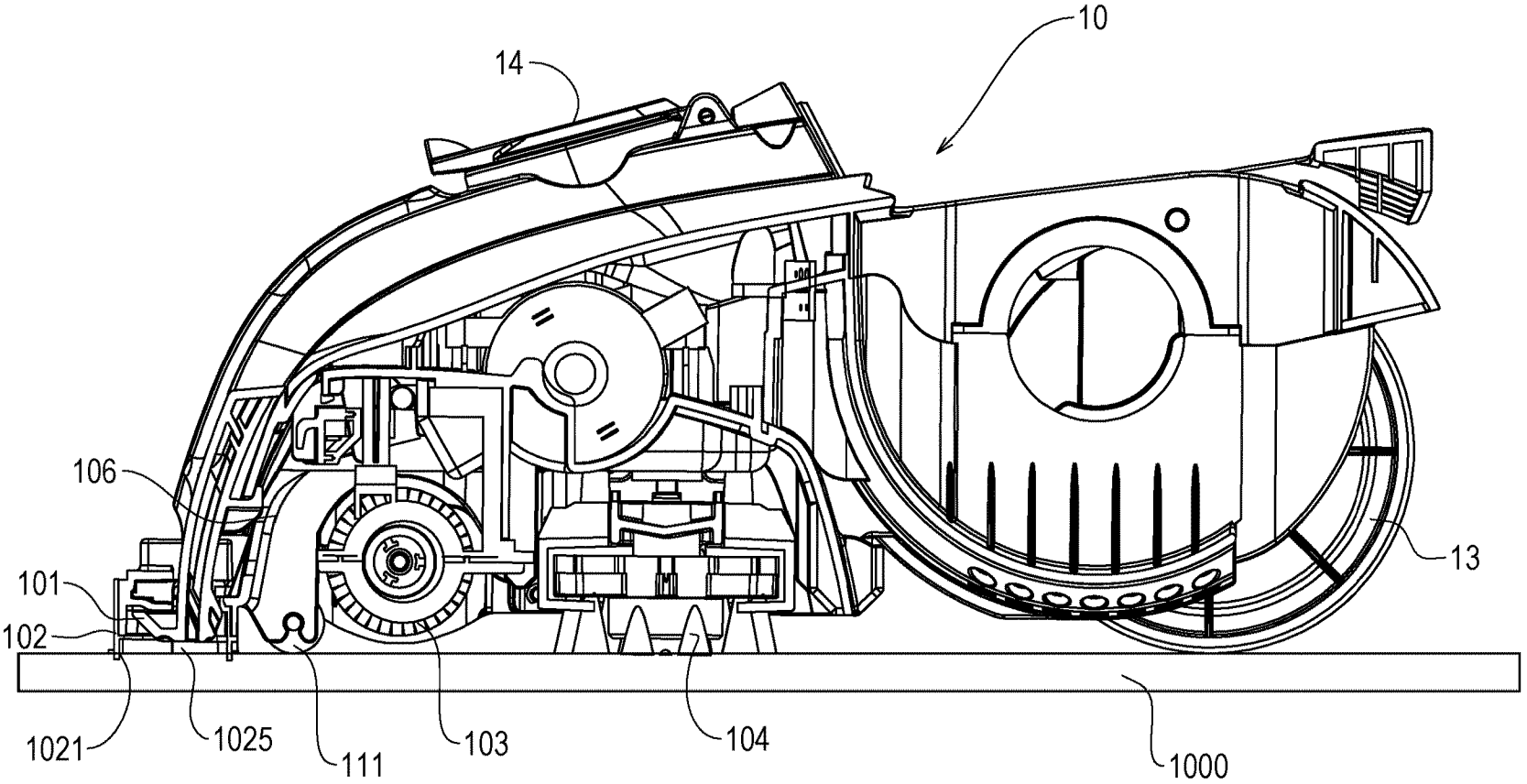
FIG. 10 shows a cross sectional view of a head according to an embodiment of the present invention in a second configuration.

FIGS. 4, 6 and 9 show the inlet extension member 102 in the first position and FIGS. 5, 7 and 10 show the inlet extension member 102 in the second position. When the inlet extension member 102 is moved towards the first position, the inlet 101 is locatable closer to a surface to be cleaned than an opening 1021 of the inlet extension member 102. Conversely, when the inlet extension member 102 is moved towards the second position, the opening 1021 of the inlet extension member 102 is locatable closer to the surface to be cleaned than the inlet 101.

Referring back to FIG. 8, the head 10 may also include one or more resilient biasing means 110 located between the body 100 and the frame 106. In the illustrated embodiment the resilient biasing means 110 takes the form of a pair of helical springs, one spring located at one end 1062*a* of the frame 106 and the other helical spring (not shown) located at the other end 1062*b* of the frame 106. In some embodiments fewer or greater than a pair of helical springs may be utilised. In some embodiments, it is envisaged that the resilient biasing means 110 may take other forms, such as a leaf spring or the like. The resilient biasing means 110 urges the frame 106, and hence the inlet extension member 102, towards the first position.

In order to permit movement of the inlet extension member 102 between the first and second positions, the head 10 is provided with an actuator, indicated generally at 108, which is movable between first and second actuator positions. In the illustrated embodiment the actuator 108 includes a pivot axle 1081 which connects a pair of spaced apart cams 1082*a*, 1082*b*. Each cam 1082*a*, 1082*b* has associated therewith a respective cam follower 109*a*, 109*b* formed within the frame 106. Each cam follower 109*a*, 109*b* has first 1091*a*, 1091*b* and second 1092*a*, 1092*b* cam follower surfaces. Each first cam follower surface 1091*a*, 1091*b* is configured to receive the respective cam 1082*a*, 1082*b* when the actuator 108 is moved between the first and second actuator positions, thereby causing the frame 106 to pivot about the pivot axis 107 between the first and second positions. Movement of the actuator 108 towards the second actuator position overcomes the resilient biasing means 110, thereby urging the frame 106, and hence the inlet extension member 102, towards the second position. Each second cam follower surface 1092*a*, 1092*b* is configured to receive and hold the respective cam 1082*a*, 1082*b*, thereby locking the inlet extension member 102 in the second position. In order to move the inlet extension member 102 back to the first position each cam 1082*a*, 1082*b* may be unlocked by moving the actuator 108 towards the first actuator position. This causes each cam 1082*a*, 1082*b* to come into contact with the respective first cam follower surface 1091*a*, 1091*b* and the resilient biasing means 110 urges the frame 106, and hence the inlet extension member 102, towards the first position.

The actuator 108 may include a handle 1083, so that the actuator 108 may be manually operated by a user. However, whilst the figures teach that the actuator 108 may be manually operated by a user, it is envisaged that the actuator 108 may be electronically driven, for instance by utilising a solenoid. The actuator 108 may take different forms. For instance, whilst the figures show a pair of spaced apart cams 1082*a*, 1082*b* and a pair of respective cam followers 109*a*, 109*b*, there need only be a single cam and cam follower arrangement. Furthermore, whilst the figures teach that the actuator 108 includes the cams 1082*a*, 1082*b* and the frame 106 includes the cam followers 109*a*, 109*b*, this arrangement could be the other way around without departing from the scope of the invention.

The head 10 may also include at least one wheel 111 for supporting the inlet extension member 102 when the inlet extension member is in the second position. The embodiment shown in the figures includes a pair of wheels 111, one wheel 111 being located towards one end of the inlet extension member 102 and the other wheel 111 being located towards the other end. In some embodiments a single wheel may be provided along the length of the inlet extension member 102 or, alternatively, a plurality of spaced apart wheels may be provided. The wheels 111 may be connected to the frame 106. Advantageously, the wheels 111 may be located between the inlet extension member 102 and the rotatably driven brush bar 103, so that the wheels 111 are positioned directly adjacent to the inlet extension member 102 to provide support for the inlet extension member 102 when in the second position. The inlet extension member 102 is typically formed from a rubber and is therefore inherently flexible. Advantageously, the wheel 111 provides support for the inlet extension member 102 when the inlet extension member 102 is in the second position.

Figure 2:
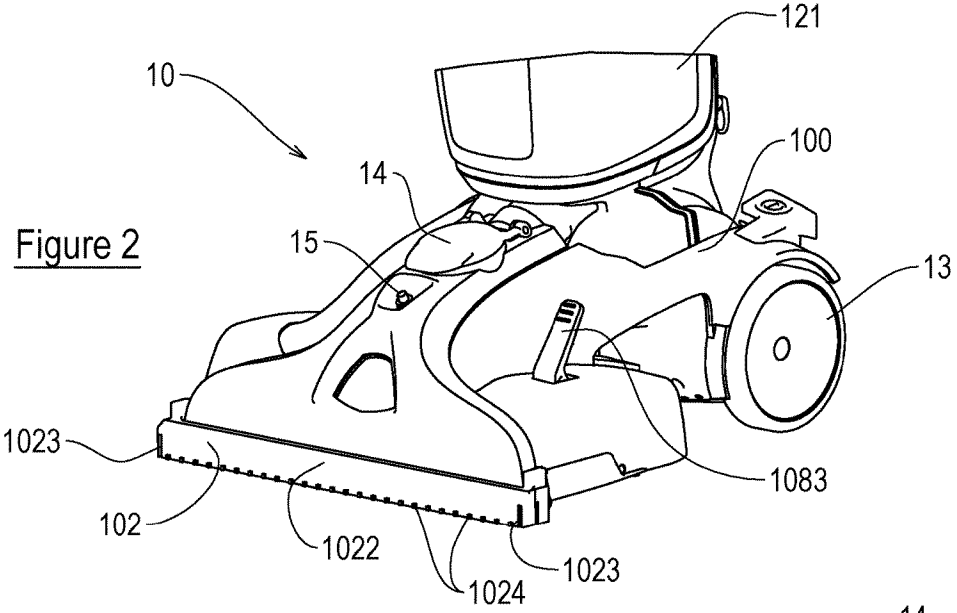
FIG. 2 shows a perspective view of a head according to an embodiment of the present invention.

Referring now to FIG. 2, the inlet extension member 102 may include a wall 1022 having one or more openings 1023 provided therein to permit the flow of fluid from outside the inlet extension member 102 to the inlet 101. Advantageously, the or each opening 1023 improves the suction capability of the inlet extension member 102 when in contact with a surface to be cleaned.

Additionally or alternatively, the wall 1022 may include a plurality of ribs 1024 located around at least a part of a periphery of the wall 1022. The gaps between the ribs 1024 have a similar effect to the openings 1023 in that they deform to permit fluid to flow from outside the inlet extension member 102 to the inlet 101.

Operation of the head 10 will now be described with reference to FIGS. 9 and 10. FIG. 9 shows the head 10 in a soft floor cleaning mode, whereby the inlet extension member 102 is resiliently biased towards the first position. The inlet 101 is located closer to the surface 1000 than the inlet extension member 102 when the head 10 is being used. Furthermore, the rotatably driven brush bar 103 and the trailing brushes 104 are in contact with the surface 1000 so as to agitate the surface during cleaning. FIG. 10 shows the head 10 in a hard floor cleaning mode, where the inlet extension member 102 is in the second position. In this configuration, the opening 1021 of the inlet extension member 102 is located closer to the surface 1000 than the inlet 101 when the head 10 is being used. Indeed, the opening 1021 is in contact with the surface 1000 and a passageway 1025 provides a flow path for the dirt-laden fluid between the opening 1021 and the inlet 101. Furthermore, the rotatably driven brush bar 103 is raised from the surface 1000. Advantageously, this configuration avoids hard surfaces from become damaged or scratched. The trailing brushes 104 are mounted such that they always remain in contact with the surface 1000 when the device 1 is being used. In other words, the trailing brushes 104 are mounted such that their height is adjustable. Therefore, when the inlet extension member 102 is in the second position the trailing brushes 104 hang from the device so as to remain in contact with the surface 1000. Since the bristles of the trailing brushes 104 are typically soft there is little or no concern that a hard floor surface will become damaged or scratched as a result of the contact between the trailing brushes 104 and the surface 1000.

In hard or soft floor cleaning mode, cleaning solution is typically dispensed from the first fluid tank 120 by operation of the trigger 17. The cleaning solution is sprayed from one or more ports (not shown) onto the surface to be cleaned. Suction is applied to the inlet 101 by a motor 105. The rotatably driven brush bar 103 and trailing brushes 104 agitate the cleaning solution and dirt-laden fluid subsequently flows through the inlet 101 and via flow path 103 to the second fluid tank 121, where it can be disposed by the user.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A head for a surface cleaning device, the head comprising:

an inlet for receiving dirt-laden fluid from a surface;

an inlet extension member, wherein the inlet extension member is movable with respect to the inlet between first and second positions;

a body; and a frame, wherein the inlet extension member is supported by the frame, and wherein the frame is pivotably connected to the body so as to be movable with respect to the inlet to move the inlet extension member between the first and second positions.

2. A head according to claim 1, wherein the inlet is locatable closer to the surface than an opening of the inlet extension member when the inlet extension member is in the first position.

3. A head according to claim 1, wherein the inlet extension member includes a passageway and wherein the or an opening of the inlet extension member is locatable closer to the surface than the inlet when the inlet extension member is in the second position, the passageway providing a flow path for the dirt-laden fluid between the opening and the inlet.

4. A head according to claim 1, wherein the inlet extension member at least partially surrounds the inlet.

5. A head according to claim 1, including a resilient biasing means located between the body and the frame and for urging the inlet extension member towards the first position.

6. A head according to claim 5, wherein the head includes an actuator movable between a first actuator position where the inlet extension member is in the first position and a second actuator position where the inlet extension member is in the second position, wherein actuation of the actuator from the first actuator position to the second actuator position causes the frame to overcome the resilient biasing means to move the inlet extension member towards the second position.

7. A head according to claim 6, wherein one of the actuator or the frame includes a cam and the other of the actuator or the frame includes a cam follower.

8. A head according to claim 6, wherein the actuator is manually driven between the first and second actuator positions.

9. A head according to claim 6, wherein the actuator is electronically driven between the first and second actuator positions.

10. A head according to claim 7, wherein the cam follower includes first and second cam follower surfaces, the first cam follower surface being configured to receive the cam when the actuator is moved between the first and second actuator positions, and wherein the second cam follower surface is configured to receive the or a cam when the actuator is moved to the second actuator position, thereby locking the inlet extension member in the second position.

11. A head according to claim 1, including an agitator.

12. A head according to claim 11, wherein the agitator includes a rotatably driven brush bar.

13. A head according to claim 12, including a wheel for supporting the inlet extension member on the surface, wherein the wheel is located between the rotatably driven brush bar and the inlet extension member.

14. A head according to claim 13, wherein the wheel is connected to the frame.

15. A head according to claim 12, wherein the rotatably driven brush bar is contactable with the surface when the inlet extension member is moved towards the first position and raisable from the surface when the inlet extension member is moved towards the second position.

16. A head according to claim 11, wherein the agitator includes a trailing brush configured to rotate about a vertical axis with respect to the surface.

17. A head according to claim 16, wherein the trailing brush is contactable with the surface when the inlet extension member is moved towards the first and second positions.

18. A head according to claim 1, wherein the inlet extension member includes a wall having an opening provided therein to permit the flow of fluid from outside the inlet extension member to the inlet.

19. A head according to claim 18, wherein the wall includes a plurality of ribs located around at least a part of a periphery of the wall.

20. A head for a surface cleaning device, the head comprising:

an inlet for receiving dirt-laden fluid from a surface;

an inlet extension member;

an agitator; and a wheel for supporting the inlet extension member on the surface, wherein the wheel is located between the inlet extension member and the agitator.

21. A head according to claim 20, wherein the agitator includes a rotatably driven brush bar.

22. A head according to claim 21, wherein the wheel is located between the rotatably driven brush bar and the inlet extension member.

23. A head according to claim 22, wherein the wheel is connected to a frame.

24. A head according to claim 21, wherein the inlet extension member is movable with respect to the inlet between first and second positions, wherein the rotatably driven brush bar is contactable with the surface when the inlet extension member is moved towards the first position and raisable from the surface when the inlet extension member is moved towards the second position.

* * * * *